US006626402B1

(12) United States Patent
Kaminstein

(10) Patent No.: US 6,626,402 B1
(45) Date of Patent: Sep. 30, 2003

(54) CLEANING TOOL HOLDER

(75) Inventor: Bruce Kaminstein, Blauvelt, NY (US)

(73) Assignee: Kaminstein Imports, Inc., Blauvelt, NY (US)

( * ) Notice: Subject to any disclaimer, the term of this patent is extended or adjusted under 35 U.S.C. 154(b) by 0 days.

(21) Appl. No.: 10/142,388

(22) Filed: May 9, 2002

(51) Int. Cl.[7] ..... A46B 17/02; A47F 7/00
(52) U.S. Cl. ..... 248/110; 248/314; 211/70.6
(58) Field of Search ..... 248/110, 111, 248/314; 211/60.1, 65, 66, 68, 70.6

(56) References Cited

U.S. PATENT DOCUMENTS

| | | | | | |
|---|---|---|---|---|---|
| 928,284 | A | | 7/1909 | Selsor | |
| 1,095,068 | A | | 4/1914 | Bate | |
| 2,538,654 | A | | 1/1951 | Petersen | |
| 2,661,920 | A | | 12/1953 | Gochenour | |
| 2,754,974 | A | * | 7/1956 | Larson | 211/70.6 |
| 2,815,863 | A | * | 12/1957 | Larson | 211/70.1 |
| 3,063,569 | A | * | 11/1962 | Huber | 211/89.01 |
| 3,095,092 | A | * | 6/1963 | Magarian | 211/70.6 |
| 3,178,141 | A | | 4/1965 | Bloom | |
| 3,298,531 | A | * | 1/1967 | Wilcke | 211/70.6 |
| 3,365,761 | A | * | 1/1968 | Kalvig | 248/113 |
| 3,524,210 | A | | 8/1970 | McLean | |
| 3,603,551 | A | * | 9/1971 | Peterson | 248/314 |
| 4,209,098 | A | * | 6/1980 | Adams | 211/70.8 |
| 4,467,925 | A | * | 8/1984 | Ratzloff et al. | 211/70.6 |
| 4,597,496 | A | * | 7/1986 | Kaplan | 211/70.6 |
| 4,667,826 | A | | 5/1987 | Salacuse | |
| 4,763,378 | A | | 8/1988 | Drumm | |
| D301,976 | S | | 7/1989 | Greenhut et al. | |
| 4,869,378 | A | * | 9/1989 | Miller | 211/94.01 |
| 4,905,951 | A | | 3/1990 | Putness | |
| 5,165,629 | A | | 11/1992 | Breveglieri | |
| 5,319,822 | A | | 6/1994 | Shaw | |
| 5,335,799 | A | * | 8/1994 | Coudron | 211/65 |
| 5,381,581 | A | | 1/1995 | Samuelsson | |
| 5,471,699 | A | | 12/1995 | Shaw | |
| 5,513,758 | A | * | 5/1996 | Lin | 211/70.6 |
| 5,568,668 | A | | 10/1996 | Margolin | |
| 5,573,019 | A | | 11/1996 | Hempel | |
| 6,068,229 | A | * | 5/2000 | Wang et al. | 248/314 |
| 6,152,312 | A | * | 11/2000 | Nava et al. | 211/94.01 |
| 6,435,357 | B1 | * | 8/2002 | Lee | 211/70.6 |

* cited by examiner

*Primary Examiner*—Anita King
(74) *Attorney, Agent, or Firm*—Stephen E. Feldman

(57) ABSTRACT

An aluminum cleaning tool holder that is rust-proof and may be hung outdoors. The cleaning tool holder has an aluminum profile into which attachment panels featuring rubber rings for hanging may be slid. Attachment panels may feature various numbers of rings and may be mixed and matched according to necessity, with more or fewer rubber rings added. Plastic lids secure the attachment panels in place. Each rubber ring features a series of interior rubber grips which are flexible and thus can accommodate a wide arrange of pole sizes from thick to thin. Additionally, each rubber grip features a hook in the front from which smaller items such as cleaning supplies or other tools may be suspended.

3 Claims, 3 Drawing Sheets

CLEANING TOOL HOLDER

FIELD OF THE INVENTION

This invention relates generally to mounted holders. In particular, the invention concerns a rust-proof aluminum cleaning tool holder with rubber grips and hooks attached for the hanging of various cleaning tools and paraphernalia.

BACKGROUND OF THE INVENTION

Just as inventors pursue continued innovations in cleaning tool design, so do they contemplate the most efficient means of storage for these tools. It has generally been found that the best means for, storage of a cleaning tool outfitted with a long pole that is used as a handle (such as a broom, mop, rake, etc.) involves the creation of a bracket, or mount, for hanging the tool against a flat surface such as a wall. This saves valuable space and prevents the cleaning implement at the end of the pole from becoming dirty or misshapen.

U.S. Pat. No. 928,284 to Selsor shows a broom holder consisting of a ring that may be mounted on a wall by means of a screw. The ring is encased in a spiral spring that grips the handle of the tool being mounted. U.S. Pat. No. 1,095,068 to Bate relates to a broom holder comprising a plate and a pair of rigid supports having the form of spools (such as for thread). The cleaning tool is then mounted between these spools, and suspended with-the cleaning end up. U.S. Pat. No. 301,976 to Greenhut et. al. shows an ornamental holder, for a broom or other cleaning tool, which also employs a ring-shape mounted on a bracket.

Various holders have also been designed which grip the handles of the cleaning tool more securely. U.S. Pat. No. 3,178,141 to Bloom discloses a gripping device for holding and supporting cleaning tools. The device comprises a monitoring bracket and a pair of resilient gripping members. U.S. Pat. No. 4,667,826 to Salacuse describes another holding device which employs a plastic clamp. This device also employs plastic hinges that are made from.the same material as the body of the clamp. Finally, U.S. Pat. No. 5,165,629 to Breveglieri shows an adjustable holding device for handling cleaning tools which can be mounted on the wall and adjusted as necessary.

None of these cleaning tool holders, however, offer an inventive system of storage such as the invention at hand. The aluminum, rust-proof, cleaning tool holder provides rubber rings that are each outfitted with interior rubber grips. These rubber grips accommodate cleaning tool handles (poles) of a variety of shapes and sizes. Rubber hooks extend from each rubber ring for the hanging of other cleaning tools and accoutrements such as rags, buckets, cleaning supplies, dusters, or other tools. Additionally, the cleaning tool holder itself can be adjusted to provide more or fewer rubber rings as needed, since the back of the mount consists of an aluminum profile into which the rubber attachment parts are slid. The attachment parts are then secured with plastic lids.

SUMMARY OF THE INVENTION

The present invention provides a rust-proof, aluminum cleaning tool holder which functions as an adaptable system. The base of the holder is comprised of an aluminum profile into which rubber attachment parts may be slid. The rubber attachment parts are themselves comprised of rubber rings outfitted with interior rubber grips. The rings are mounted either singly or in groups onto a panel which is then slid into place on the aluminum profile. Additionally, each rubber ring features a protruding rubber hook which may be used to suspend other cleaning tools or products such as rags, dusters, etc. Plastic lids are inserted at the edges of the profile to hold the rubber attachment parts in place.

The present invention is a versatile cleaning tool holder which may be adjusted according to the needs of the user. Rubber rings may be added or removed from the aluminum profile as necessary, and the interior rubber grips ensure that tools with handles of any size may be suspended from the rubber rings .

DETAILED DESCRIPTION OF THE INVENTION

Figure 1:
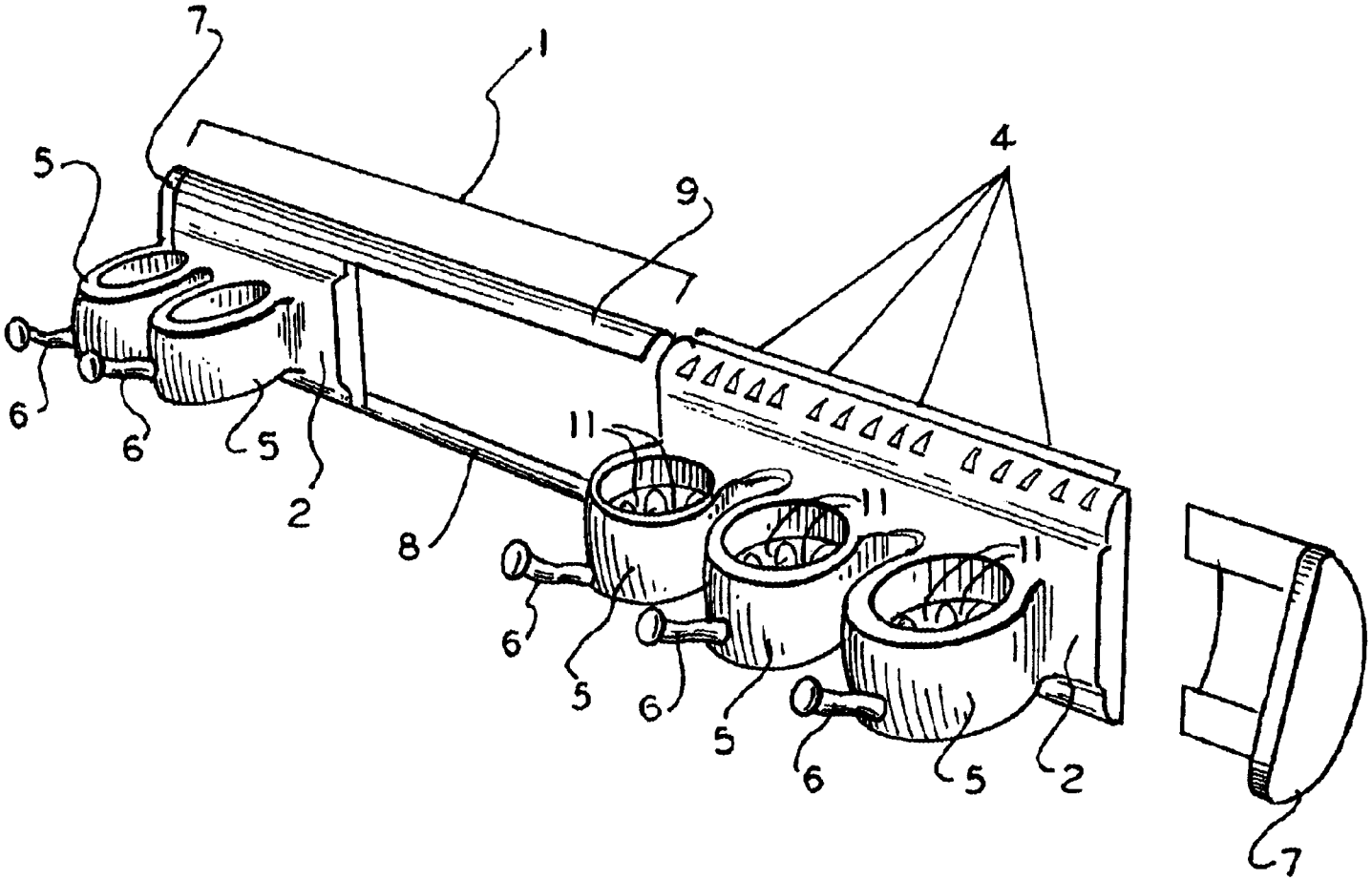
FIG. 1 illustrates a perspective view of the separate cleaning tool holder components in mid-assembly.

FIG. 1 shows a view of the separate cleaning tool holder components in mid-assembly. An aluminum profile 1 serves as the base for the cleaning tool holder. The aluminum profile 1 is a flattened piece of aluminum with two inwardly curving lips 8 and 9. The aluminum profile 1 may also have a bracket on the back (not visible in this illustration) which assists in connecting the cleaning tool holder to the wall. Rubber attachment parts or panels 2 are then slid between lips 8 and 9 of the aluminum profile 1. These attachment panels 2 consist of flattened panels from which protrude the rubber ring holders 5 from which the cleaning tools will be suspended. Attachment panels 2 may have varying numbers of rubber ring holders 5 attached so that different combinations may be created by sliding different attachment panels 2 into the aluminum profile 1. This is especially helpful since more room may be needed to comfortably suspend a cleaning tool that features an excessively large cleaning implement on one end. Plastic lids 7 are inserted at either end of the aluminum profile 1 and hold the attachment panels 2 securely in place.

Each rubber ring 5 is circular in shape, and contains a central hole. The edges of each rubber ring 5 are smooth and rounded. Each rubber ring 5 is outfitted with interior rubber grips 11. These rubber grips 11 protrude from the interior of the rubber rings 5 in a star shape, and are made of rubber or plastic. When a cleaning tool handle is inserted through the middle of a rubber ring 5, rubber grip 11 conforms to the shape of the handle and grips it tightly, regardless of the handle's size. Additionally, a hook 6 protrudes from each rubber ring 5, offering additional hanging space for alternative cleaning tools and/or supplies. The hooks 6 are also of a rounded shape, and extend smoothly from the rubber ring 5. The tip of each hook 6 is molded into the shape of a small ball so as to prevent items from slipping off the hooks 6.

Figure 2:
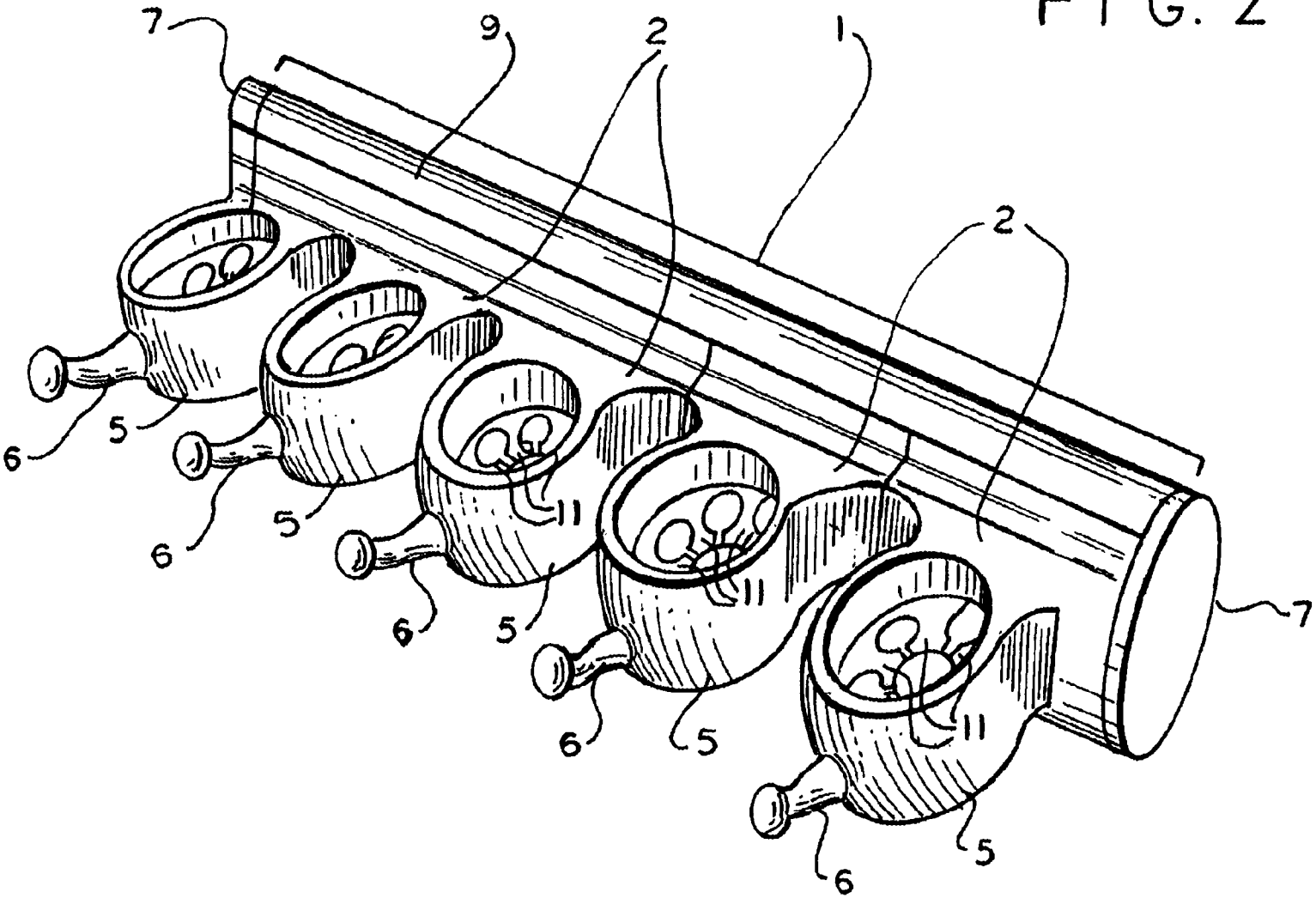
FIG. 2 illustrates a perspective view of the assembled cleaning tool holder.

FIG. 2 illustrates the cleaning tool holder in the assembled position. Here the plastic lids 7 are clearly visible in position, serving as the rounded sides of the holder. Once in place, the attachment panels 2 create a seamless unit with the aluminum profile 1. The rubber rings 5 extend from the attachment panels 2 at a reasonable distance so that cleaning tools may be hung from their handles, either with the cleaning implement end suspended above or below the rubber rings 5. Extending from each rubber ring 5 is a hook 6, each hook having an orb shaped end to prevent the item being hung upon the hook 6 from sliding off.

Figure 3:
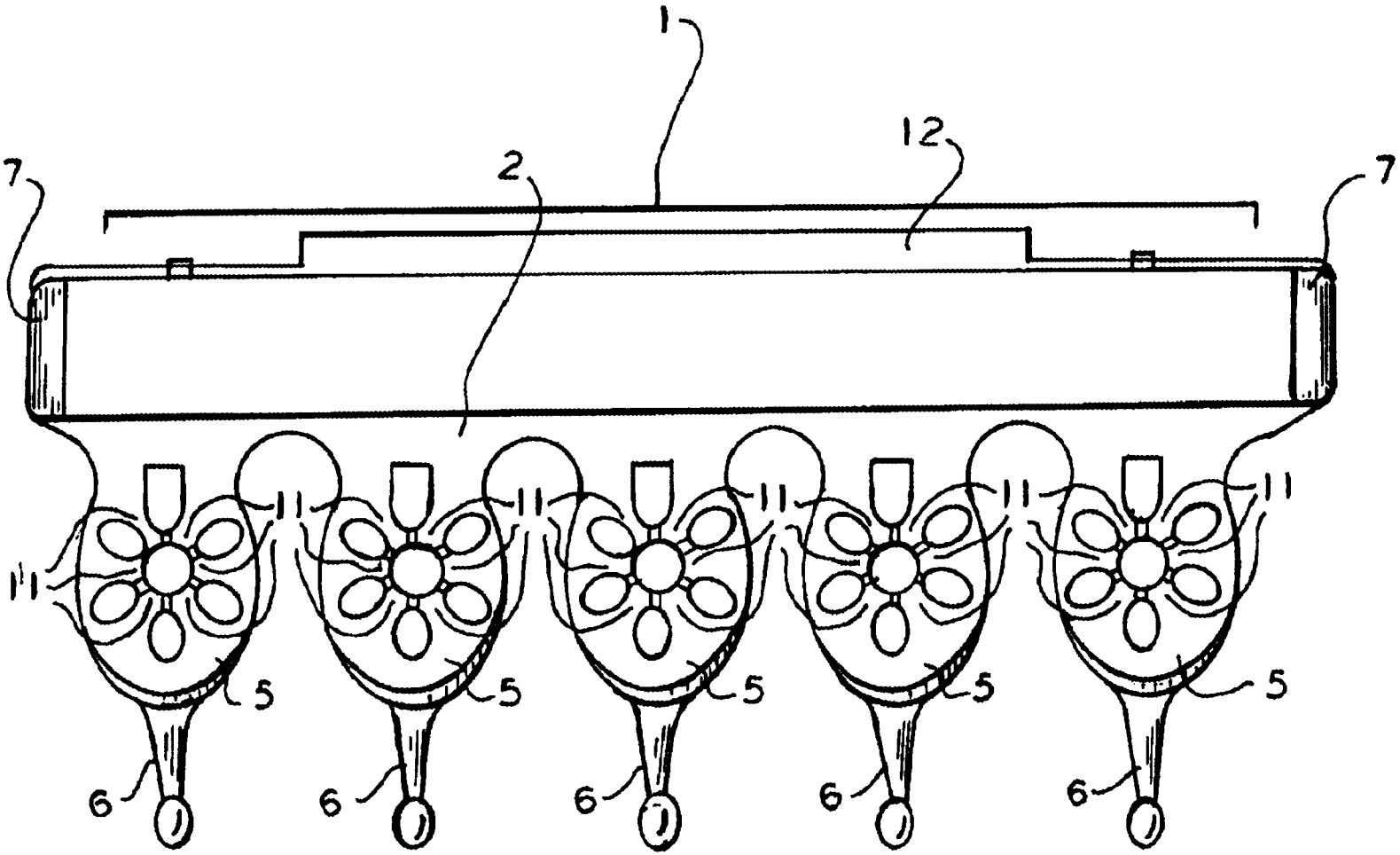
FIG. 3 illustrates a plan view of the assembled cleaning tool holder.

FIG. 3 illustrates a plan view of the cleaning tool holder. In this view, the bracket 12 mounted on the back of the aluminum profile 1 is clearly visible. The bracket 12 may be used to mount the holder onto a flat surface such as a wall. Also fully visible in this illustration are the interior rubber grips 11. Each grip extends from the interior of a rubber ring 5 to form a circular support for the handle of the cleaning too. Since the interior rubber grips 11 are flexible, the rubber rings 5 are able to accommodate cleaning tool handles of virtually any size, and to grip the handle firmly and securely into place, as long as the handle has a lesser circumference than the rubber grip 5.

When the appropriate number of attachment panels 2 are chosen and inserted into the aluminum profile 1, the entire holder may be attached to a flat surface such as a wall, in a manner such that the rubber rings 5 protrude outwards from the profile 1. To store a cleaning tool such as a broom on the cleaning tool holder, the handle may be slipped into one of the rubber rings 5 either from below or from above. Rubber grips 11 will then grip the cleaning tool and hold it securely in place. Additionally, smaller tools or supplies such as rags may be hung from the hooks 6 that protrude from each of the rubber rings 5.

Additional variations of the broom are also possible and contemplated that will fall within the spirit and scope of this invention as further defined by the claims that follow.

What is claimed:

1. A cleaning tool holder comprising:

a. a profile configured for mounting on a flat surface;

b. the profile being designed to accommodate the addition of flexible attachment panels;

c. the attachment panels providing at least one ring for hanging;

d. the ring being rubber and having interior grips from which the handles of tools may be hung;

e. the attachment panels being secured into said profile by means of two lids affixed to either end of said profile;

f. the rubber interior grip featuring a hook;

g. the hook having a rounded tip to prevent slippage of hung objects.

2. A cleaning tool holder as claimed in claim 1 the cleaning tool holder is constructed of aluminum and wherein the aluminum is rust-proof.

3. A cleaning tool holder as claimed in claim 1 wherein at least one panel is slid into the profile and secured by the plastic lids.

* * * * *